United States Patent [19]

Harmon

[11] Patent Number: 4,970,835

[45] Date of Patent: Nov. 20, 1990

[54] WALL ANCHORING DEVICE AND METHOD OF INSTALLATION

[76] Inventor: Rick A. Harmon, 623 N. 11th St., Canton, Ill. 61520

[21] Appl. No.: 362,202

[22] Filed: Jun. 6, 1989

[51] Int. Cl.[5] ..... E04G 23/02; E02D 5/74

[52] U.S. Cl. ..... 52/162; 52/742; 52/293

[58] Field of Search ..... 405/262; 52/742, 162, 52/163, 169.1, 293

[56] References Cited

U.S. PATENT DOCUMENTS

| | | | |
|---|---|---|---|
| 744,421 | 11/1902 | Small | 52/162 |
| 848,634 | 4/1907 | Coghlin | 52/163 |
| 3,250,075 | 5/1966 | Webb et al. | 405/262 |
| 3,815,368 | 6/1974 | Turzillo | 52/742 |
| 4,189,891 | 2/1980 | Johnson et al. . | |

*Primary Examiner*—James L. Ridgill, Jr.

[57] ABSTRACT

A wall anchoring device for straightening a bowed foundation wall, and a method of anchoring the foundation wall to the surrounding soil, including an elongate member engaging a hollow tube at one end for driving an opposite chisel end of the tube into the earth. The hollow tube includes pivotable anchor arms that spread away from the hollow tube which is drawn back toward the foundation wall to anchor the device to the earth. A brace plate is forced against the interior of the foundation wall by tightening a fastening nut onto the elongate member so that outward pressure is applied to the foundation wall to straighten it.

14 Claims, 2 Drawing Sheets

WALL ANCHORING DEVICE AND METHOD OF INSTALLATION

BACKGROUND AND SUMMARY OF THE INVENTION

The invention is generally related to anchoring a foundation wall to prevent further cracking and bowing, and to straighten a bowed foundation wall. In particular, the invention is directed towards a wall anchoring device, and method for installing the device, whereby the foundation wall is anchored to the surrounding earth and can be periodically tightened to maintain constant outward force on the foundation wall.

Foundation walls for commercial or residential structures, and the like, are subject to external forces caused by soil expansion and groundwater. During dry summer weather, the surrounding earth tends to lose moisture and shrink. It thus pulls away from the foundation leaving gaps and cracks. When wet weather returns, the flow of rainwater washes new soil into the gaps and pockets left by the dry weather. In the frost belt latitudes, when the saturated earth is frozen during the winter season, the water naturally expands and creates intense forces against foundation walls. The earth pressure will bow a foundation wall inward and cause the wall to crack. This also produces seepage into the interior of the structure.

Repeated annual wet and dry conditions cause further cracks and bowing over time.

Prior art techniques for repairing foundation wall damage due to the frozen and thawing conditions have typically required costly excavation procedures to relieve the pressure and realign the foundation wall. This conventionally requies the use of mechanical excavation equipment and additional personnel for both the structural work and earthmoving steps. The repair of foundation walls located adjacent exterior structures or fixtures, such as driveways, sidewalks, patios, utility lines, porches, decks, gardens, etc., usually result in their displacement or total destruction in order to gain access to the foundation wall. Of course, during winter conditions with deep frost, the excavation procedures are either precluded or prohibited due to increased cost and effort.

One technique for straightening foundation walls is shown in U.S. Pat. No. 4,189,891 issued to Johnson et al., which provides for securing a plate interiorly of the foundation wall and anchoring a connected elongated member through an excavation made in the ground at a distance from the wall. The elongated member is anchored in the excavation and is pulled to cause the plate to be forced against the interior of the foundation wall. However, the technique requires excavation which is undesirable due to the need to destroy and replace lawns, driveways, patios, shrubbery, etc., which might be in the way. Also, the difficulty during frozen conditions makes this form of wall straightening often difficult, if not precluded, during winter conditions.

It is accordingly an object of the invention to stop the deterioration of a foundation wall caused by exterior earth or hydrostatic pressures. It is additionally and object of the invention to restore the foundation wall to a condition approaching the original construction integrity.

It is an allied goal of the invention to achieve the reinforcement and repair of a foundation wall without excavating or replacement of the foundation wall.

It is an adjunct objective of the invention to provide for the repair and reinforcement of a foundation wall without the destruction and replacement of exterior driveways, patios, sidewalks, shrubbery, landscaping, and the like.

It is another goal of the invention to provide an apparatus for achieving the reinforcement of a deteriorating foundation wall and further having the capability of tightening adjustment whereby to periodically re-stress the foundation wall outwardly toward its original constructed plumb condition.

It is a concomitant object of the invention to achieve the foregoing results by a method that is completely performed by one worker inside the foundation wall during any season of the year without major reconstruction or heavy equipment.

It is also a goal of the invention to provide an apparatus and method for preventing further cracking and bowing of a foundation wall of virtually any construction, e.g., concrete block, poured concrete, or wood.

It is therefore the major goal of the invention to stop and reverse the inward bowing and to prevent the impending collapse of a below-ground foundation wall caused by soil and water pressure by means of anchoring the wall and thereafter straightening the wall.

The wall anchoring device may be summarized as comprising a tube having a chisel point end to be driven through the foundation wall into the earth and carrying a plurality of pivotal spade arms adjacent the chisel point. At the opposite end, the tube has a threaded interior which threadingly engages an elongate rod that extends from and through the foundation wall. A slot adjacent the threaded tube end accommodates a sliding set pin which stops the inward travel of the threaded rod. A further threading of the rod into the tube draws the pointed hollow tube toward the foundation wall thereby initiating a spreading of the spade arms. Thereafter, at the interior of the foundation wall, a wall plate is forced thereagainst by a nut that is tightened to pull the hollow tube and chisel arm and spade arms closer to the foundation wall thereby firmly digging the spread spade arms within the earth. The inventive method includes the installation of the wall anchoring device by first driving the hollow chisel pointed tube into the soil by means of an elongate member attaching to the end of the hollow tube and pressing the pointed hollow tube into the soil. Then, the threaded member is further thread engaged to the tube up to a point that is limited by the set pin in the side slot in order to partially extend the spade arms away from the body of the hollow tube. The wall anchoring plate is arranged at the wall over the threaded member of a tightening nut is placed on the rod. Next, the nut is tightened to draw the elongate member and spade arms in a direction back through a foundation wall and thereby forcing the wall plate against the foundation wall to anchor the wall to the soil. Periodically, the nut may be further tightened to keep outward force on the foundation wall to continue correcting the wall. Additional objects and features of the invention will be appreciated and understood from the attached drawings and following description of the invention.

DETAILED DESCRIPTION OF THE INVENTION

Figure 1:
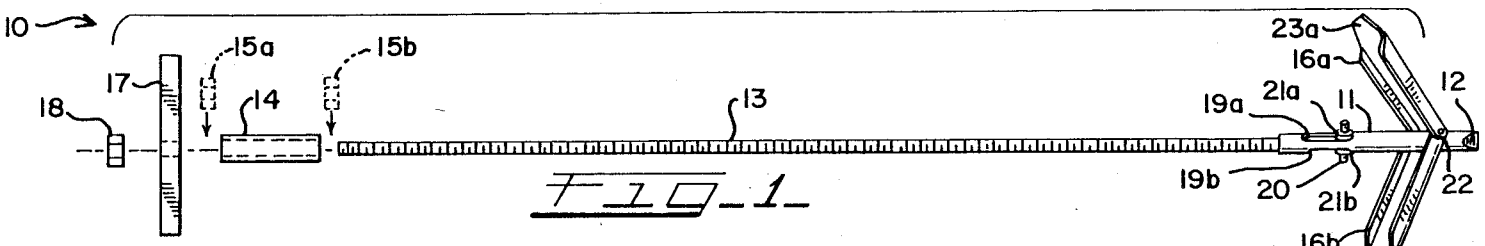
FIG. 1 is a plan view of the wall anchoring device, partially exploded at one end thereof.

The invention will be described in conjunction with the drawings wherein like reference numerals throughout refer to the same elements.

The invention is directed toward the installation of a wall anchoring device 10 shown in a partially exploded view in FIG. 1. The device 10 comprises a hollow tube 11 with a pointed chisel end 12 that is threadingly engaged with an elongate threaded member, or rod, 13 which may comprise a single threaded member or two shorter members connected by a coupler. A sleeve 14 is provided to be inserted through a foundation wall as a sealing means, but rubber grommets 15*a*, 15*b* may be optionally used as a wall sealing means. The sleeve 14 and/or grommets 15*a*, 15*b*, are provided for arrangment on the elongate threaded rod 13 at an opening bored through the foundation wall. The hollow tube 11 carries pivotable spade arms 16*a*, 16*b*, which are trough-shaped and arranged to pivot away from the hollow tube 11 for anchoring engagement with the earth as will be explained. At the opposite end of the threaded rod 13, a wall brace plate 17 is provided to be placed against the interior of a foundation wall so that a nut 18 may be threadingly tightened on the threaded rod 13 to pull the hollow tube 11 toward the foundation wall and fully pivot the pivotable spade arm 16*a*, 16*b* to dig into the earth.

The hollow tube 11 further includes corresponding slots 19*a*, 19*b* which slidingly receive a case hardened set pin 20 transversely therethrough. The set pin 20 is movably held in the slots 19*a*, 19*b* by means of washers 20*a*, 20*b* affixed thereto exteriorly of the hollow tube 11.

The spade arm 16*a*, 16*b* are hingedly joined on the tube 11 at a pivot pin 22, which extends through the hollow tube 11. The ends of the outer sides of the spade arms 16*a*, 16*b* adjacent the pivot 22 are notched for a short distance from the pivot 22 whereby the spade arms 16*a*, 16*b* may pivot but caused to bind against the hollow tube 11 before reaching 90 degrees thereto. Preferably the arms 16*a*, 16*b* have a trough-like shape with distal, generally pointed end portions 23*a*, 23*b* for digging into the earth.

Figure 2:
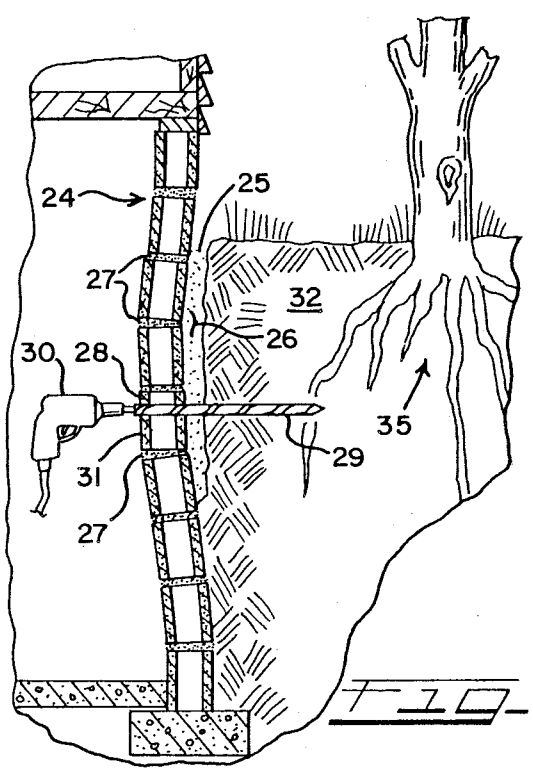
FIG. 2 is a cross sectional view of a foundation wall showing a preliminary step in the installation procedure wherein a hole is bored through the foundation wall.

Turning now to FIG. 2, a bowed cinder block foundation wall 24 is shown in cross section. Bowing can be caused when during dry conditions the surrounding earth creeps away from the wall, such as shown at gap 25, wherein soil and other materials may later fill in the gap as shown at 26. Then, upon the invasion of rainfall or snow, the freezing and thawing of this additional accumulated material 26 is forced toward the foundation wall 24 causing it to bow inwardly and crack as at 27, usually between wall blocks. The passive earth pressure and hydrostatic pressure caused by groundwater, can cause severe damage to foundation walls, which is compounded by the additional problem of seepage into a basement or the like. The present invention provides for the method of installing the anchoring device 10 to prevent wall collapse and, in some cases, to restore the foundation wall to plumb position.

In practicing the invention, firstly the point of cracking, usually the largest zone of deflection, is determined. Preferably, a hole is then bored through the foundation wall at about twelve inches below this zone of maximum bowing, generally denoted at 28 in FIG. 2. A two inch diameter core bit 29 is driven by a hammer drill 30 to penetrate the foundation wall, in this case through a cinder block 31, and for about a two foot distance into the surrounding earth 32.

Figure 3:
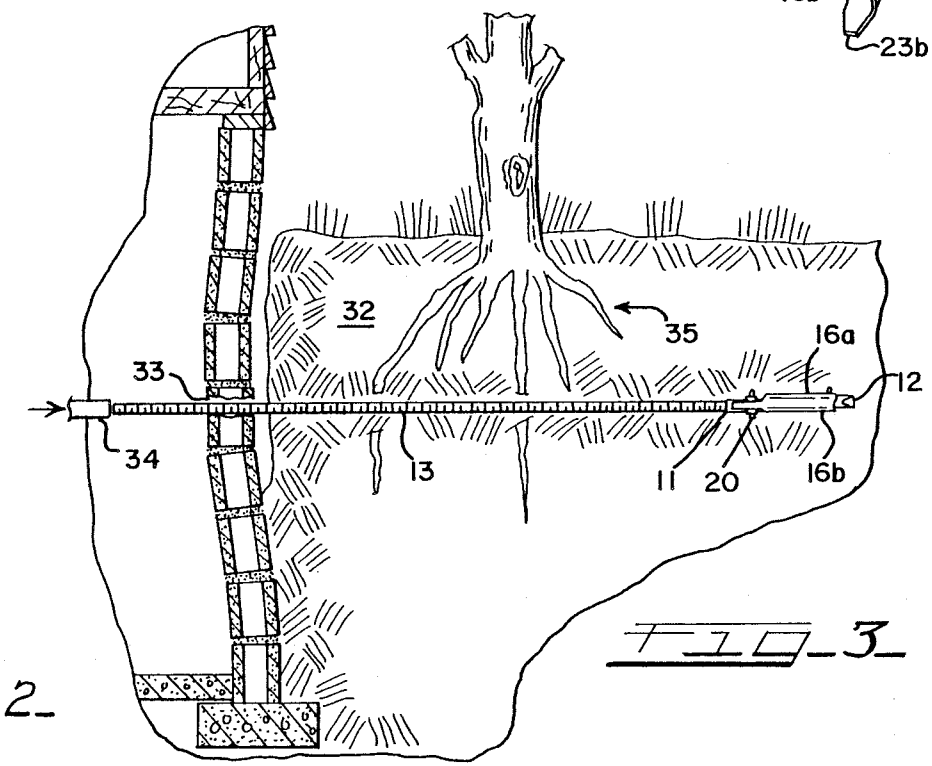
FIG. 3 shows the step of driving the chisel pointed tube carrying the folded spade arms by means of impacting a threaded elongate member joined to the tube and extending through the foundation wall.

With reference now to FIG. 3, the following steps for the installation of the anchoring device 10 will be explained. The core bit 31 is withdrawn. Next, the hollow tube 11 having collapsed spade arms 16*a*, 16*b* is fed into an opening or bore 33 made by the core bit 31. The threaded rod 13 is then threaded partway into the hollow tube 11 until it just reaches the set pin 20 at the point where the set pin is at its rearmost position in the slots 19*a*, 19*b*, i.e., closest to the end opposite the chisel point 12.

Then, as partially depicted at the left side of FIG. 3, a jackhammer 34 may be used to drive the threaded rod 13 and the attached hollow tube 11, in a direction as noted by the arrow, into the earth 32 outward of the foundation wall 24. It is desirable to drive the anchoring device 10 into the soil at a downward angle of preferably about 15 to 30 degrees to achieve solid fractional anchoring in the soil Usually a 20 degree inclination to horizontal is optimal. As an alternative, the threaded rod 13 may be provided in two sections, e.g., a first three-foot section and then a second six foot section whereby to make handling and the jackhammering step somewhat easier by working with shorter lengths. Also, space may be confined inside a basement, or the like, and the two piece construction for the threaded rod 13 might be a desirable space-efficient option for working around hot water heaters, dryers, furnaces, etc., often found in basements. A double-ended and interiorly threaded coupling tube or union might be used to join a two part threaded rod 13 in a conventional coupling connection, as would be understood.

The threaded rod 13 is driven into the soil until about six inches of the rod protrudes inside the wall 24. While the distance that the anchoring device 10 may be driven into the soil can, of course vary, the hollow tube 11 of the exemplary embodiment is an 18 inch length of one inch diameter (O.D.) pipe and the threaded rod 13 comprises nine linear feet of $\frac{3}{4}$ inch threaded metal rod. Therefore, with conventional foundation wall thickness of about six to twelve inches, by leaving a six inch projection of the threaded member 13 inwardly of the foundation wall 24, the chisel point 12 of the anchording device 16 is projected into the earth about eight to ten feet.

Next, the spreading of the spade arms 16*a*, 16*b* is made. This is begun by the rotation of the threaded rod 13, as best viewed in FIG. 4. A pulling back of the hollow tube 11 is required to make the arms 16*a*, 16*b* dig in and spread. This is achieved by threading the threaded rod 13 into the threaded hollow rear portion of the hollow tube 11 to thereby incrementally draw the hollow tube 11 back toward the wall 24. The threaded travel of the threaded rod 13 is limited by the set pin 20, which is urged by the rod 13 to the other end of the slots 19*a*, 19*b*. At that point, the rod 13 cannot further engage the tube 11 and the set pin 20 serves as a limit stop. In the exemplary embodiment, the slots are about 2¾' long whereby the tube 11 is also drawn back this distance to partially spread and dig the arms 16*a*, 16*b* into the earth. The threading rotation of the rod 13 may be achieved by means of, for example, a wrench 35.

The invention envisions various means for preventing foreign material, moisture, soil, radon gas, etc., from entering the basement through the aperture 33 in the wall 24. These sealing means include the aforementioned rubber grommets 15*a*, 15*b*, which are usable alone or in conjunction with the sleeve 14 therebetween. Another alternative is the utilization of a cementitious material, such as mortar, to be packed within the aperture 33 around the threaded member 13. Also, the cementitous material also may be used with the rubber grommets 15*a*, 15*b* placed at opposite sides of the wall 24, or solely in conjunction with the sleeve 14 whereby the space between the sleeve 14 and the threaded rod 13 may be filled with mortar. Another option is a double-sleeve arrangement wherein a small diameter smooth sleeve would be placed over the threaded rod 13 and the larger diameter sleeve 14 could be again inserted into the aperture 33 around the smaller tube. In this mode the space between the sleeve 14 and the smaller smooth tube could be filled with mortar, or sealing material, such as elastomeric caulk and the like.

Figure 4:
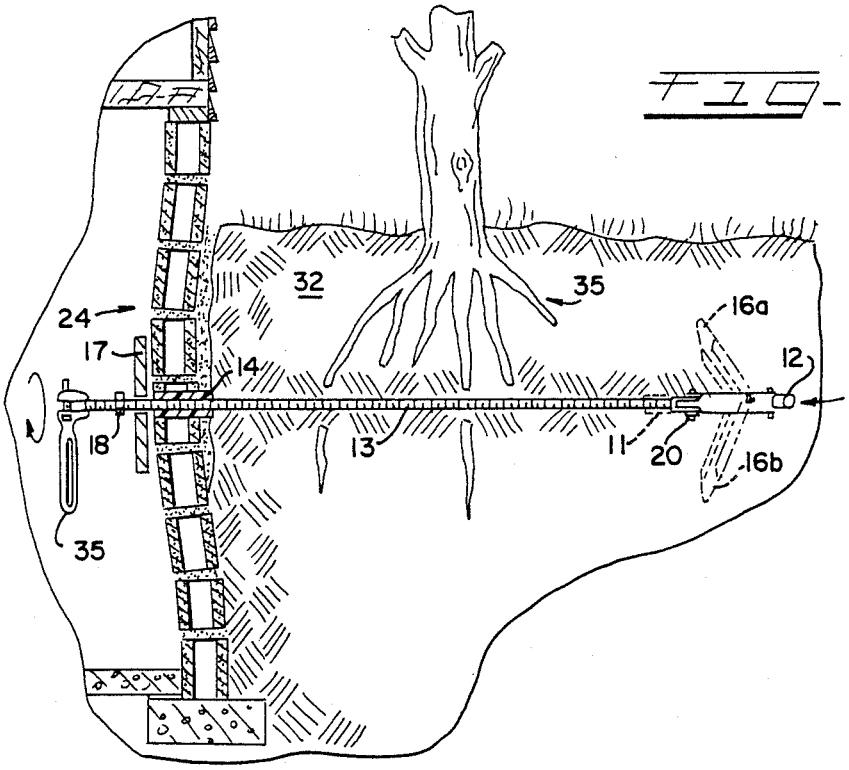
FIG. 4 shows the further step of rotating the threaded member to draw the pointed tube member slightly back toward the foundation wall and thereby partially spreading the anchoring spade arms; and, FIG. 5 shows the placement of the wall plate against the foundation wall and tightening a nut to draw the threaded member and hollow tube back towards the foundation wall for a secure anchoring of the wall to the earth.

The next phase of the installation procedure will be explained in conjunction with one of the alternate preferred forms for sealing the aperture 33, namely using the sleeve 14 and a mortar fill. In this disclosed embodiment, the sleeve 14 is placed over the threaded rod 13. The sleeve 14 is a standard PVC (polyvinyl chloride) pipe cut to about eight inches long and having a two inch outside diameter to fit within the bore 33. It is forced through the aperture 33 until the interior end is flush with the wall 24. Then, mortar is packed around the threaded rod 13 to seal the space between the sleeve 14 and the threaded rod 13. Next, the interior brace plate 17, a washer (not shown), and the nut 18, are placed around the threaded rod 13 as shown in FIG. 4. The nut 18 is loosely tightened toward the wall 24.

In another optional form of the invention, the step of threading the rod 13 to force the set pin 20 through the slots 19*a*, 19*b* to initiate the spreading of the arms 16*a*, 16*b*, may be made after the brace plate 17, nut 18 and washer are placed on the rod 13, but preferably before the mortar is packed inside the sleeve 14.

Figure 5:
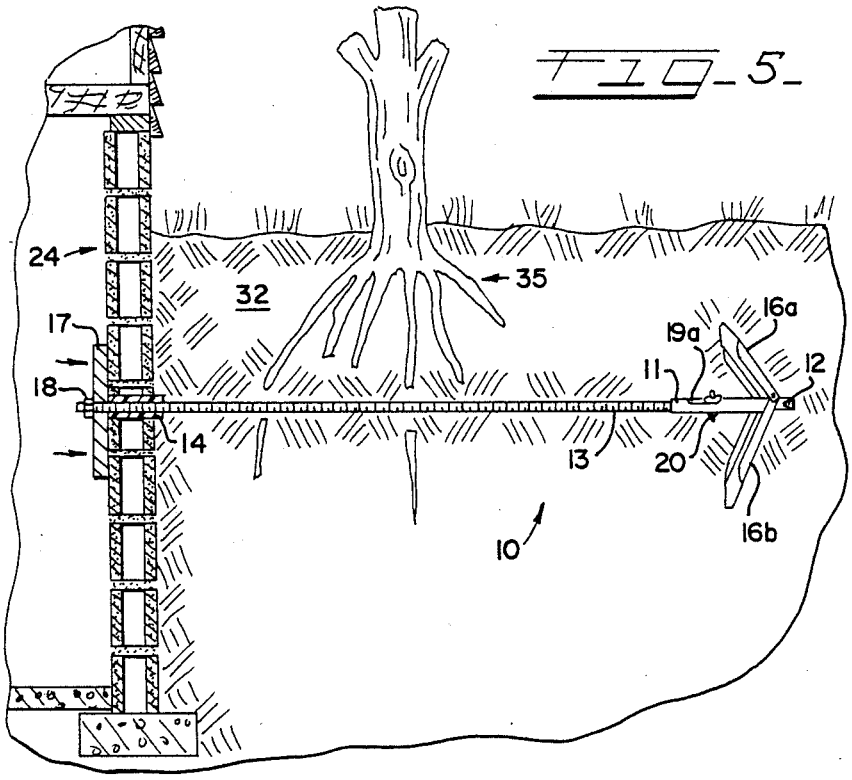

Turning now to FIG. 5, a forceful anchoring of the wall 24 is achieved by means of gripping the nut 18 with the wrench 35 and tightening the nut and washer against the brace plate 17. It is desirable to keep the brace plate vertical during this procedure. In the example shown, the brace plate 17 is 24 inches long by three inches wide, and consists of ⅛ thick steel plating. The nut 18 is preferably tightened to about 100 to 110 foot-pounds of torque. This causes the spade arms 16*a*, 16*b* to firmly grip into the earth 32. Pressure is thereby exerted, shown by the arrows, against the wall 24 as the brace plate 17 is pressed to it. Any excess length of the threaded rod 13 projecting inwardly of the wall 24 may then be cut off.

Periodically, the nut 18 may be tightened to maintain the 100 to 110 foot pounds of torque. Over time, the pressure against the wall 24 by the brace plate 17 will gradually pull the bowed wall 24 outwardly toward plumb.

In the alternative utilizing the rubber grommets 15*a*, 15*b*, the grommet 15*b*, shown in FIG. 1, may first be placed over the threaded rod 13 prior to the injection of the sleeve 14. Then, the grommet 15*a* is placed over the threaded rod 13, followed by the positioning of the brace plate 17 and attachment of a washer and the nut 18. The thread engagement of the threaded rod 13 with the hollow tube 11 to initiate spreading the arms 16*a*, 16*b*, is then made. Next, mortar may be placed between the sleeve 14 and threaded member 13. Thereby, upon tightening the brace plate against the wall 24, the grommet 15*a* will be compressed against the inside of wall 24 while the grommet 15*b* will be pulled against the outside of the wall 24 for additional sealing of the aperture 33. The grommets 15*a*, 15*b*, may be used alone without the sleeve 14, whereby the cavity between the aperture 33 and threaded member 13 may be fully filled with mortar. Other equivalent sealing means for preventing the entrance of soil, radon gas, foreign material, insect infestation, and the like, fall within the scope of the invention.

The installation of the anchoring device 10 is manually conducted totally within the basement at the interior side of the wall 24. The pointed chisel end 12 of the hollow tube 11 will cut through tree roots, vegetation, etc. as shown at the root system 35 in the Figures. The chisel point 12 also offers the benefit of being capable of deflecting off roots, underground debris, rocks etc., as the threaded member 13 is driven by the jackhammer 34. Above ground, no effect is noticed and driveways, patios, shrubbery, gardens, and the like, will not be disturbed. Of course, buried utilities, cables, water lines, and the like, would require the installer to check for their location, which usually can be easily determined. Since the anchor device 10 requires no excavation and only a relatively small diameter bored extension into the earth, damage to utilities and the like, will be easily avoided.

The invention as claimed includs a broad range and the foregoing is a description of a preferred embodiment for the purposes of illustrating the practice of the invention without limitation thereto.

What is claimed is:

1. A below ground driveable wall anchoring device requiring no excavating or backfilling, said device comprising:

a hollow driveable tube having a pointed earth penetrating end, pivotal earth anchoring arms, a pivot pin means pivotally securing the earth anchoring arms to the hollow driveable tube, a thread-engageable hollow end opposite the earth penetrating end, and a limit stop pin and slot means adjacent the thread-engageable hollow end;

elongate driveable rod means having one end thereof threadingly engaged at said thread-engageable hollow end of the driveable tube and an opposite thread-engageable end for extending through a wall to be anchored;

brace plate means capable of fitting over the opposite thread-engageable end of the elongate driveable rod means for forcibly pressing against the interior of a wall to be anchored;

tightening means for thread-engaging said opposite thread-engageable end of the elongate driveable rod means for pressing said brace plate against a wall to be anchored;

means for sealing the elongate driveable rod means with respect to a wall to be anchored; and, wherein the elongate driveable rod means and engaged hollow driveable tube capable of being driven together into the ground at the exterior of a wall to be anchored.

2. The wall anchording device as claimed in claim 1 wherein said limit stop pin and slot means comprises slots having movably residing therein a set pin capable of being urged longitudinally within said slots toward the pointed end of said driveable tube by thread-engageable rotation of said one end of the elongate driveable rod means.

3. A wall anchoring device as claimed in claim 1 wherein said means for selling comprises sleeve means for extending around said elongate driveable rod through a wall to be anchored and being spaced therearound for receipt of sealing material therein.

4. A wall anchoring device as claimed in claim 1 wherein said pivotal earth anchoring arms comprises a pair of arms pivotally joined at said pivot pin means and each arm capable of moving from a position generally flattened against said hollow driveable tube to a position forming an acute angle therewith.

5. A foundation wall anchoring device installable from the interior of a foundation wall, said device comprising:

an earth-penetrating first member having a pointed front end for driving into the earth and a hollow thread-engageable opposite end, a pair of pivoting arms each pivotable from an arrangement generally flattened against the earth-penetrating member to a position forming an acute angle therewith, a pivot pin means pivotally securing the arms to said earth-penetrating member, and a slideable stop pin residing within slot means formed through the earth-penetrating member adjacent said hollow thread-engageable opposite end;

at least one elongate rod means having an end capable of thread engaging the hollow thread-engageable opposite end of said earth-penetrating member;

a brace plate for placement around said elongate rod means to be forced against the interior of a foundation wall; and, thread engageable fastening means thread-engageable with an opposite end of said elongate rod means for extending through a foundation wall whereby to be capable of being threaded along the elongate rod means for tightening against said brace plate and forcing the brace plate against a foundation wall.

6. The wall anchoring device as claimed in claim 5 further including foundation wall sealing means for sealing between said elongate rod means and a foundation wall.

7. A wall anchoring device as claimed in claim 5 wherein said elongate rod means is formed of two connected sections.

8. A method for anchoring a foundation wall to the surrounding earth comprising:

forming an opening through a foundation wall;

inserting a tubular earth penetrating member having a pointed end through the opening and penetrating into the surrounding earth;

thread-attaching an elongate rod means a first distance into a thread hollow end of the tubular earth penetrating member opposite the pointed end;

driving the elongate rod means and attached earth penetrating member further into the surrounding earth;

thread-attaching said elongate rod means a second distance into the hollow end of said earth penetrating member;

urging a limit stop pin means of said earth penetrating member to a limit stop position preventing further thread-engagement by said elongate rod means and thereby causing said earth penetrating member to move back towards the foundation wall and partially spreading pivotal anchoring arm members of said earth penetrating member;

placing a brace plate around said elongate rod means at the interior of the foundation wall;

attaching thread-engageable fastening means to the elongate rod means at the interior of the foundation wall;

tightening the fastening means and thereby further spreading the pivotal anchoring arm members; and, forcing said brace plate against said foundation wall to create outward pressure against said foundation wall.

9. A method as in claim 8 further comprising the step of sealing the opening formed through said foundation wall.

10. The method as in claim 8 further including connecting a plurality of elongate rod means together to drive said earth penetrating member.

11. The method as in claim 8 wherein the driving step includes driving said elongate rod means and earth penetrating member at a downward inclination.

12. The method according to claim 8 further including the step of subsequently re-tightening said fastening means to maintain pressure against said foundation wall.

13. A method for straightening the wall of a structure receiving inward forces from surrounding earth conditions and comprising the steps of:

boring a hole through said wall;

jack hammering an earth penetrating rod member through said opening and into said surrounding earth;

thread tightening an elongate member to said earth penetrating member to draw said earth penetrating member back towards said wall and thereby partially spreading anchor arm means carried by said earth penetrating member;

stopping further thread tightening by contacting said elongate member against a slidable limit stop of said earth penetrating member anchoring said wall to the earth by means of tightening a fastening means onto said elongate rod member against a plate means arranged interiorly of the wall on said elongate rod member;

pulling said earth penetrating member back toward the wall and fully spreading said anchor arm means; and, creating outward pressure against said wall by said plate means.

14. The method as in claim 13 further comprising the step of sealing the hole bored through said wall.

* * * * *